US007658636B2

(12) United States Patent
Takeuchi et al.

(10) Patent No.: US 7,658,636 B2
(45) Date of Patent: Feb. 9, 2010

(54) BOARD MOUNTED ELECTRICAL CONNECTOR

(75) Inventors: Ryotaro Takeuchi, Yamato (JP); Tomonari Kaneko, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/883,311

(22) PCT Filed: Jan. 27, 2006

(86) PCT No.: PCT/US2006/002967

§ 371 (c)(1),
(2), (4) Date: Apr. 4, 2008

(87) PCT Pub. No.: WO2006/081439

PCT Pub. Date: Aug. 3, 2006

(65) Prior Publication Data

US 2008/0207014 A1 Aug. 28, 2008

(30) Foreign Application Priority Data

Jan. 28, 2005 (JP) ..... 2005-021640

(51) Int. Cl.
*H01R 13/627* (2006.01)

(52) U.S. Cl. ..... 439/357; 439/74

(58) Field of Classification Search ..... 439/74, 439/353, 357, 358, 101, 108
See application file for complete search history.

(56) References Cited

U.S. PATENT DOCUMENTS 5,120,256 A * 6/1992 Walden ..... 439/553
5,167,528 A 12/1992 Nishiyama et al.
5,178,564 A 1/1993 Kachlic et al.
5,188,535 A 2/1993 Bertho et al.
5,381,464 A 1/1995 O'Keefe et al.
5,395,265 A 3/1995 DiMondi et al.
5,928,003 A * 7/1999 Kajinuma ..... 439/74
6,132,258 A 10/2000 Kajinuma
6,368,154 B1 4/2002 Hirata et al.

(Continued)

FOREIGN PATENT DOCUMENTS

EP 0 658 951 A1 6/1995

(Continued)

OTHER PUBLICATIONS

International Search Report for PCT/US06/002967.

*Primary Examiner*—Felix O Figueroa
(74) *Attorney, Agent, or Firm*—Timothy M. Morella

(57) ABSTRACT

A board-to-board electrical connector assembly includes a first connector having a dielectric housing for mounting on a first printed circuit board for receiving a plug portion of a second connector mounted on a second printed circuit board. The connectors are mateable in a mating direction. A plurality of first conductive terminals are mounted on the housing of the first connector along the receptacle for engaging a plurality of second conductive terminals mounted along the plug portion of the second connector. A first retention member is mounted on one of the connectors and is engageable with a second retention member on the other connector in the mating direction. The first retention member includes a flexible engaging portion which extends in a direction generally perpendicular to the mating direction. The second retention member includes a rigid engaging portion for engaging and flexing the flexible engaging portion to hold the connectors in mated condition.

14 Claims, 4 Drawing Sheets

U.S. PATENT DOCUMENTS

| | | | | |
|---|---|---|---|---|
| 6,466,867 | B1 | 10/2002 | Sakashita | |
| 6,799,979 | B1 * | 10/2004 | Huang | 439/74 |
| 2003/0100211 | A1 | 5/2003 | Wu | |
| 2004/0014335 | A1 | 1/2004 | Igarashi et al. | |
| 2004/0185690 | A1 | 9/2004 | Huang | |

FOREIGN PATENT DOCUMENTS

| | | |
|---|---|---|
| JP | H05-002385 | 1/1993 |
| JP | 2004-055306 | 2/2004 |
| JP | 2004-055463 | 2/2004 |
| JP | 2004-055464 | 2/2004 |
| JP | 3564558 | 6/2004 |

* cited by examiner

FIG.8
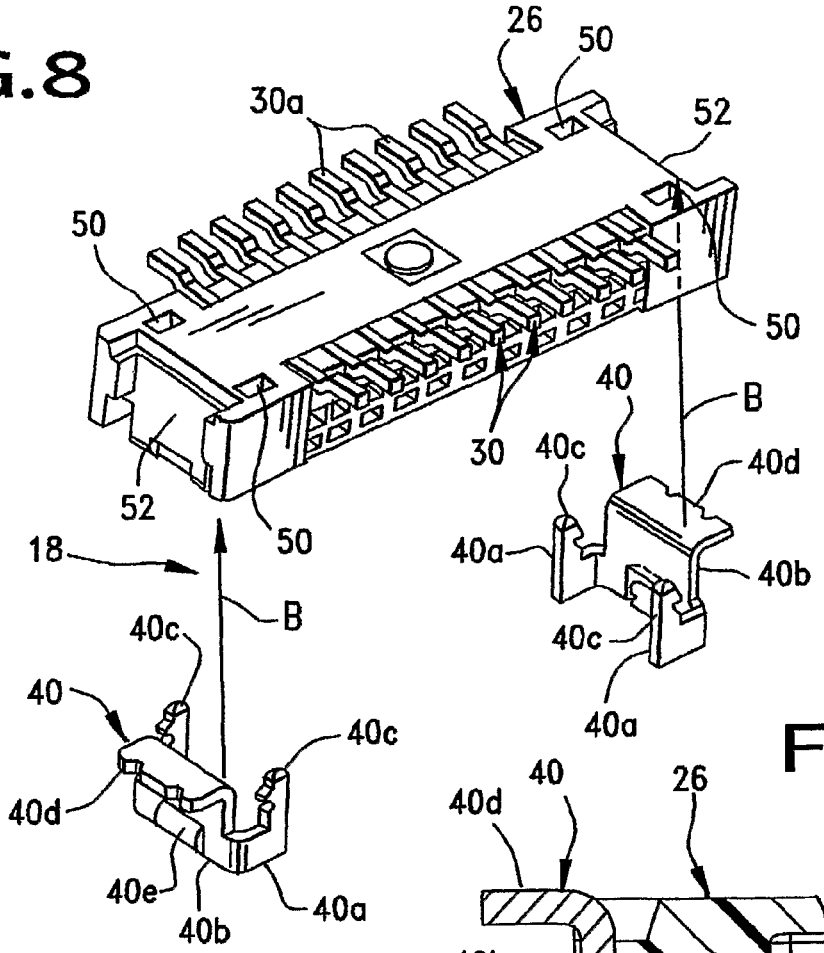
FIG.9
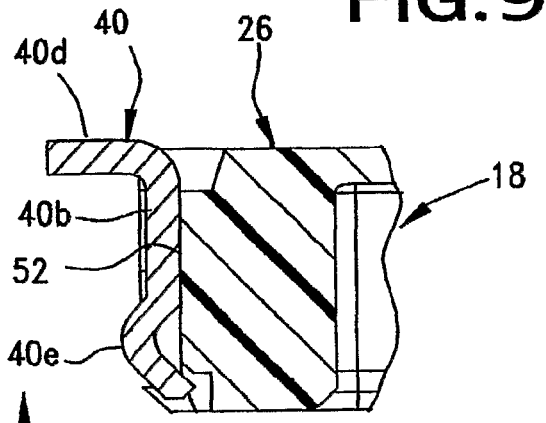
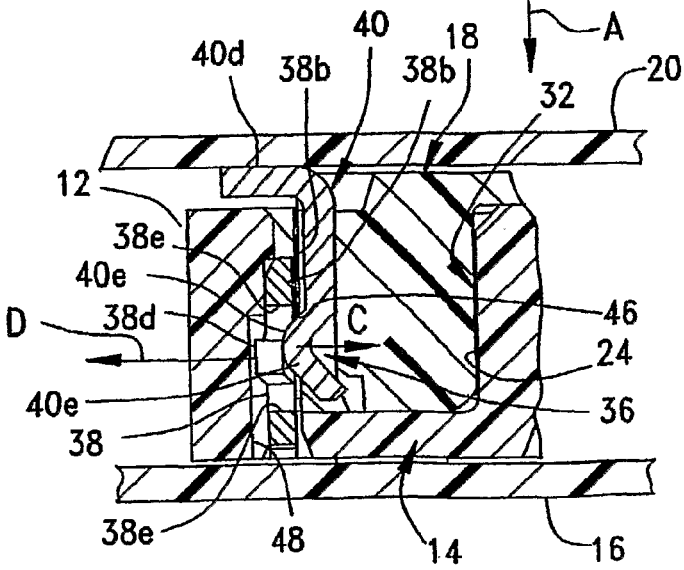
FIG.10

BOARD MOUNTED ELECTRICAL CONNECTOR

FIELD OF THE INVENTION

This invention generally relates to the art of electrical connectors and, particularly, to a board mounted electrical connector such as in a board-to-board connector assembly.

BACKGROUND OF THE INVENTION

Miniature board-to-board electrical connector assemblies are known in the art. Conventionally, a first or receptacle connector is mounted on a first printed circuit board, and a plug or second connector is mounted on a second printed circuit board. The plug connector is inserted into the receptacle connector, with the two printed circuit boards in generally parallel relationship.

For example, such board mounted electrical connectors are used in portable telephones, digital video cameras, digital still cameras or the like. In such small electronic devices, multiple circuit boards are disposed within a narrow confined space, and the connectors are used to provide electrical connection between the boards.

Conventionally, retention means are provided to hold the connectors in mated condition. Heretofore, a retention member having a first engaging portion is mounted on one of the connectors, and a second retention member having an engaging portion is mounted on the other connector. One of the engaging portions on one of the retention members comprises a protrusion which engages a flexible or spring engaging portion on the other retention member, thereby preventing inadvertent decoupling of the connectors. Examples of such retention means are shown in Japanese Patent Documents JP 2004-55306 A (which has a United States counterpart in U.S. Pat. No. 7,128,581); JP 2004-55463 A; JP 11-74024 A (which has a United States counterpart in U.S. Pat. No. 6,466,867); and Utility Model Application Laid-Open No. Hei 5-2385.

With conventional retention means, such as in Japanese Patent Document JP 2004-55306 A, the spring engaging portion on one of the one retention members is relatively long and extends in the mating or height direction of the connectors. This makes it difficult to miniaturize the connectors or reduce the connector heights. If the length of the spring engaging portion is reduced to reduce the height of the connector, a limitation is imposed on the elastic force of the spring engaging portion and causes a large force to act on the base of the spring, resulting in possible elastic deformation of the spring engaging portion. The elastic deformation makes it disadvantageously impossible to retain the connectors in mated condition.

In addition, the retention members often are used as ground terminals between a pair of circuit boards. If the spring engaging portion undergoes elastic deformation, the contact forces between the ground terminals is decreased, making the electrical connection unstable and reducing the reliability of the grounding function. The present invention is directed to solving this myriad of problems.

SUMMARY OF THE INVENTION

An object, therefore, of the invention is to provide a new and improved electrical connector assembly of the character described.

In the exemplary embodiment of the invention, a board-to-board electrical connector assembly includes a first connector having a dielectric housing for mounting on a first printed circuit board for receiving a plug portion of a second connector mounted on a second printed circuit board. The connectors are mateable in a mating direction. A plurality of first conductive terminals are mounted on the housing of the first connector along the receptacle for engaging a plurality of second conductive terminals mounted along the plug portion of the second connector. A first retention member is mounted on one of the connectors and is engageable with a second retention member on the other connector in the mating direction. The first retention member includes a flexible engaging portion which extends in a direction generally perpendicular to the mating direction. The second retention member includes a rigid engaging portion for engaging and flexing the flexible engaging portion to hold the connectors in mated condition.

According to one aspect of the invention, the first and second retention members are mounted on the first and second connectors, respectively. The flexible engaging portion of the first retention member is located inside the receptacle of the first connector. The rigid engaging portion of the second retention member is located outside the plug portion of the second connector.

According to another aspect of the invention, the flexible engaging portion of the first retention member is elongated and is cantilevered within a retention opening which receives the rigid engaging portion of the second retention member. As disclosed herein, the flexible engaging portion comprises a first flexible engaging portion, and a second flexible engaging portion is cantilevered within the retention opening and extends toward the first flexible engaging portion. The rigid engaging portion of the second retention member engages both flexible engaging portions.

According to a further aspect of the invention, the receptacle of the first connector and the plug portion of the second connector are generally rectangular, including major sides and minor ends. The terminals are spaced along the major sides, and the retention members are in pairs at the minor ends.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 8 is a perspective view of the top connector in FIG. 1, with the retention members removed;

FIG. 9 is a fragmented, enlarged vertical section taken generally along line 9-9 in FIG. 2; and FIG. 10 is a view somewhat similar to that of FIGS. 6 and 9, but with the connectors mated and coupled to their respective printed circuit boards.

DETAILED DESCRIPTION OF THE PREFERRED EMBODIMENT

Figure 1:
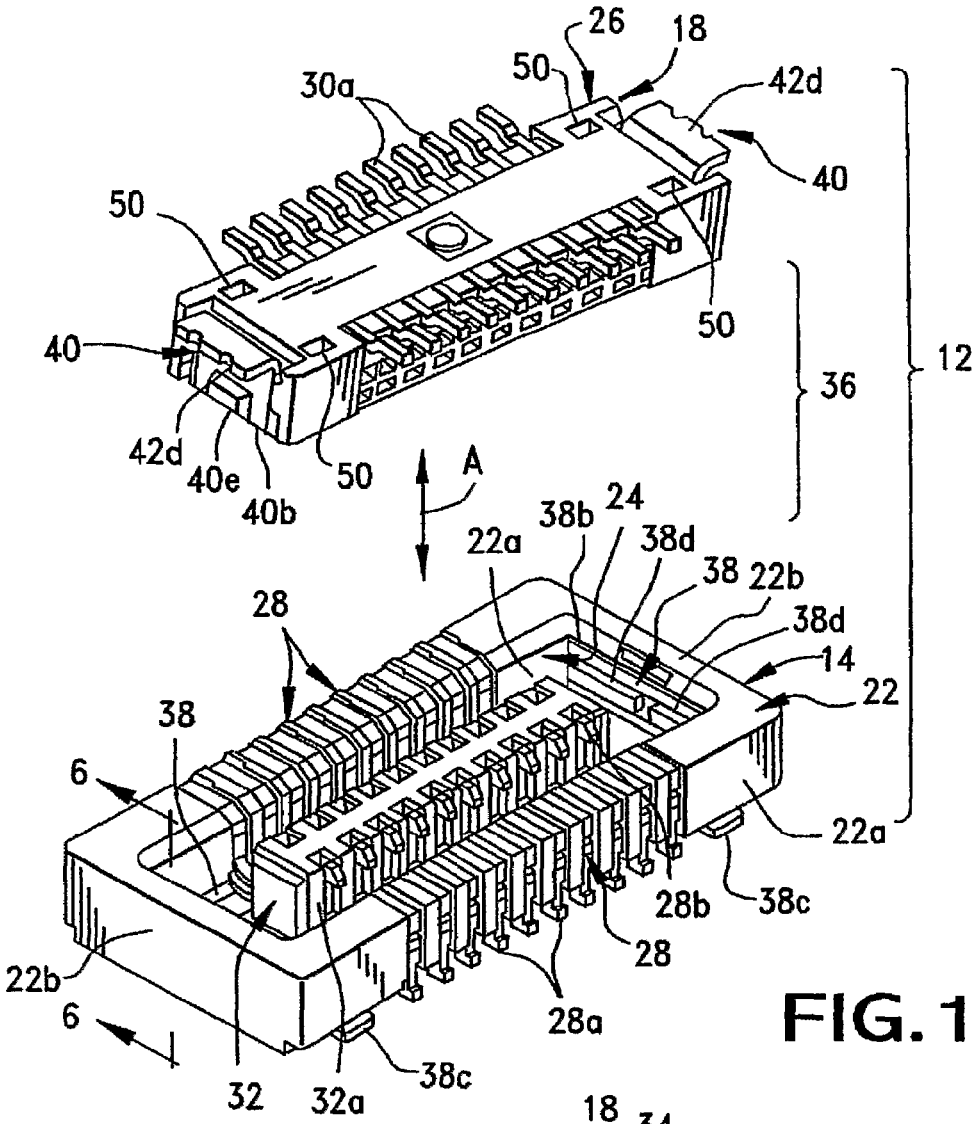
FIG. 1 is a perspective view of a pair of connectors of a board-to-board electrical connector assembly according to the invention.

Referring to the drawings in greater detail, and first to FIG. 1, the invention is embodied in a board-to-board electrical connector assembly, generally designated 12, which includes a first electrical connector, generally designated 14, mounted on a first printed circuit board 16 (FIG. 10), and a second connector, generally designated 18, mounted on a second printed circuit board 20 (FIG. 10). The first connector includes a dielectric housing, generally designated 22, which includes a pair of opposite side walls 22*a* and a pair of opposite end walls 22*b* which combine to define a generally rectangular receptacle, generally designated 24. The housing is generally rectangular, whereby side walls 22*a* are major sides walls and end walls 22*b* are minor end walls.

Figure 2:
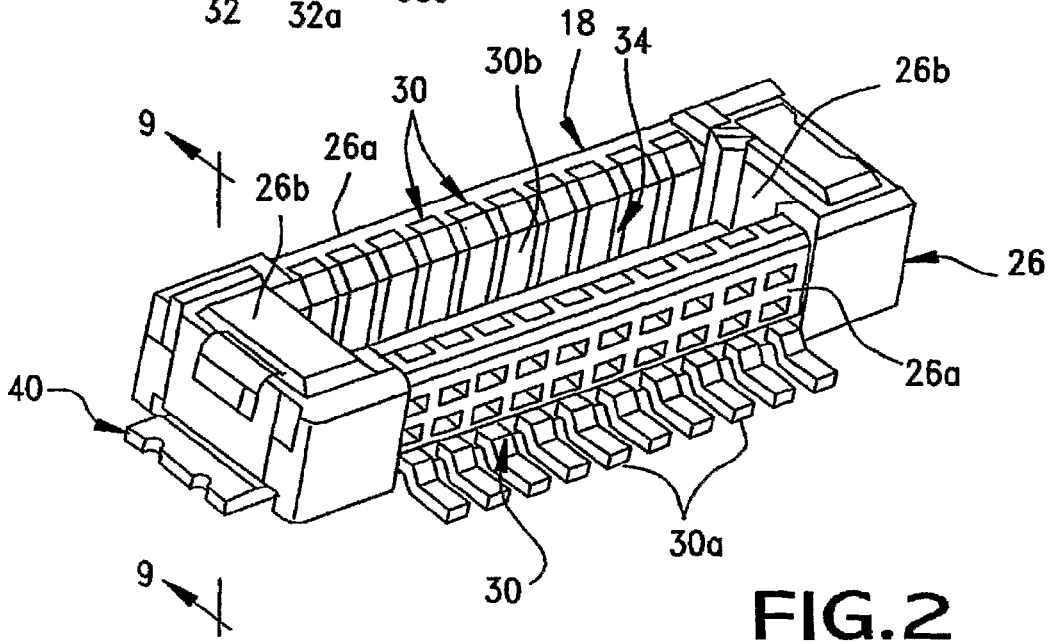
FIG. 2 is a perspective view of the mating face of the top or first connector shown in FIG. 1.

Referring to FIG. 2 in conjunction with FIG. 1, second connector 18 includes a dielectric housing, generally designated 26, which is generally rectangular and includes a pair of opposite side walls 26*a* and a pair of opposite end walls 26*b* which combine to define a rectangular structure which is insertable into rectangular receptacle 24 of first connector 14. The housings of the connectors may be molded of plastic material. Side walls 22*a* of the housing of the first connector mount a plurality of conductive terminals, generally designated 28, and side walls 26*a* of the housing of the second connector mount a plurality of conductive terminals, generally designated 30. Terminals 28 have tail portions 28*a* for connection, as by soldering, to appropriate circuit traces on printed circuit board 16. Terminals 30 have tail portions 30*a* for connection, as by soldering, to appropriate circuit traces on printed circuit board 20. Therefore, both connectors have two rows of interengaging or mating terminals.

Rectangular receptacle 24 in housing 22 of first connector 14 surrounds an elongated or rectangular platform, generally designated 32 (FIG. 1), which has opposite side surfaces 32*a*. Terminals 28 have contact portions 28*b* which project outwardly from side surfaces 32*a*. The connectors are mateable in a mating direction as indicated by the double-headed arrow "A" in FIG. 1. When the connectors are mated, platform 32 becomes inserted into an elongated recess, generally designated 34 (FIG. 2), in housing 26 of second connector 12. Terminals 30 have contact portions 30*b* at the inside surfaces of side walls 26*a* of housing 26 for engaging contact portions 28*b* of terminals 28.

Generally, the invention contemplates the provision of retaining means 36 for holding or retaining connectors 14 and 18 in their mated condition of FIG. 10. The retaining means is provided by a pair of first retention members, generally designated 38, on first connector 14 and a pair of second retention members, generally designated 40, on second connector 18. The first retention members 38 are mounted on end walls 22*b* of housing 22 of first connector 14. The retention members 40 are mounted on end walls 26*b* of housing 26 of second connector 18.

Figure 3:
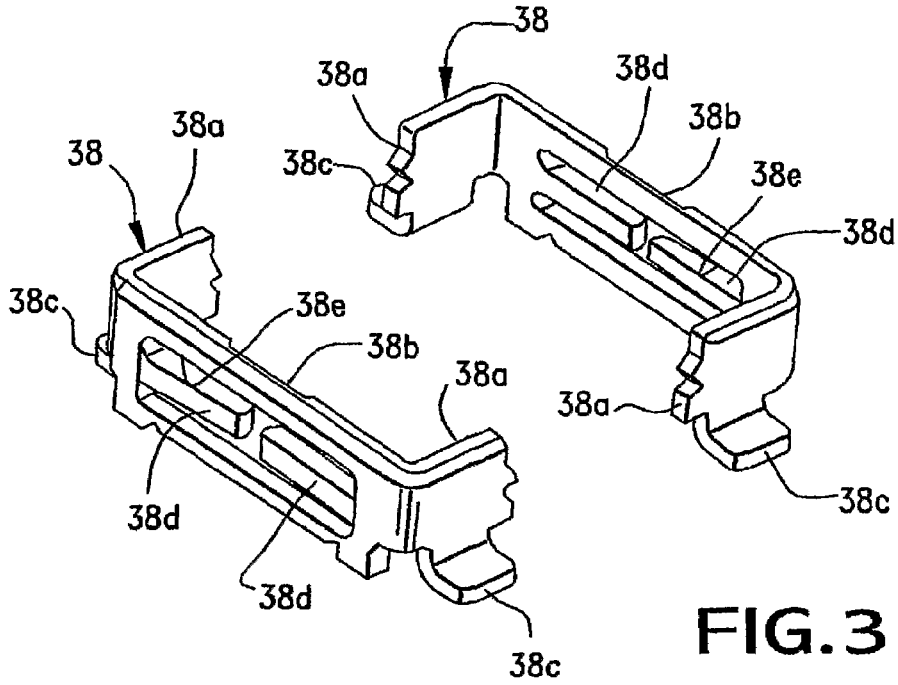
FIG. 3 is a perspective view of the two retention members mounted at opposite ends of the bottom or first connector shown in FIG. 1.
Figure 4:
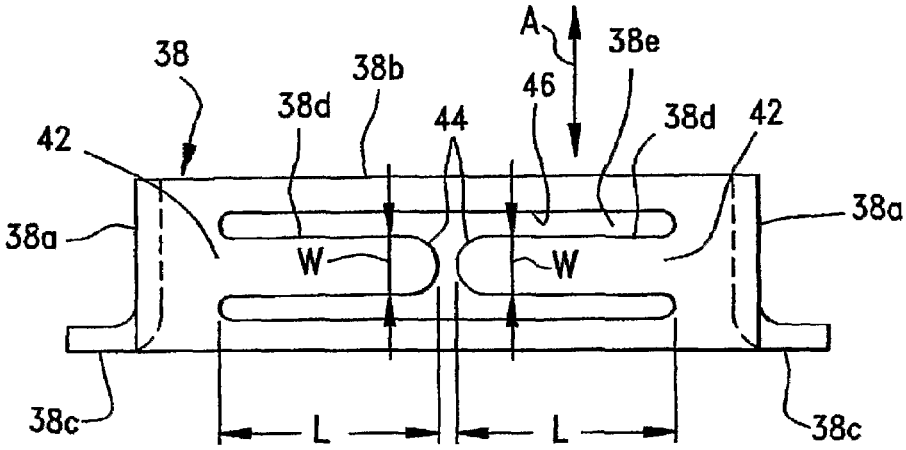
FIG. 4 is an enlarged elevational view of one of the retention members shown in FIG. 3.
Figure 6:
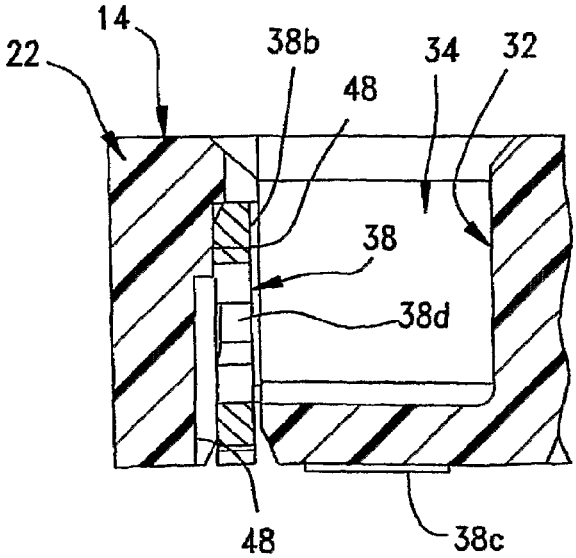
FIG. 6 is a fragmented, enlarged vertical section taken generally along line 6-6 in FIG. 1.
Figure 5:
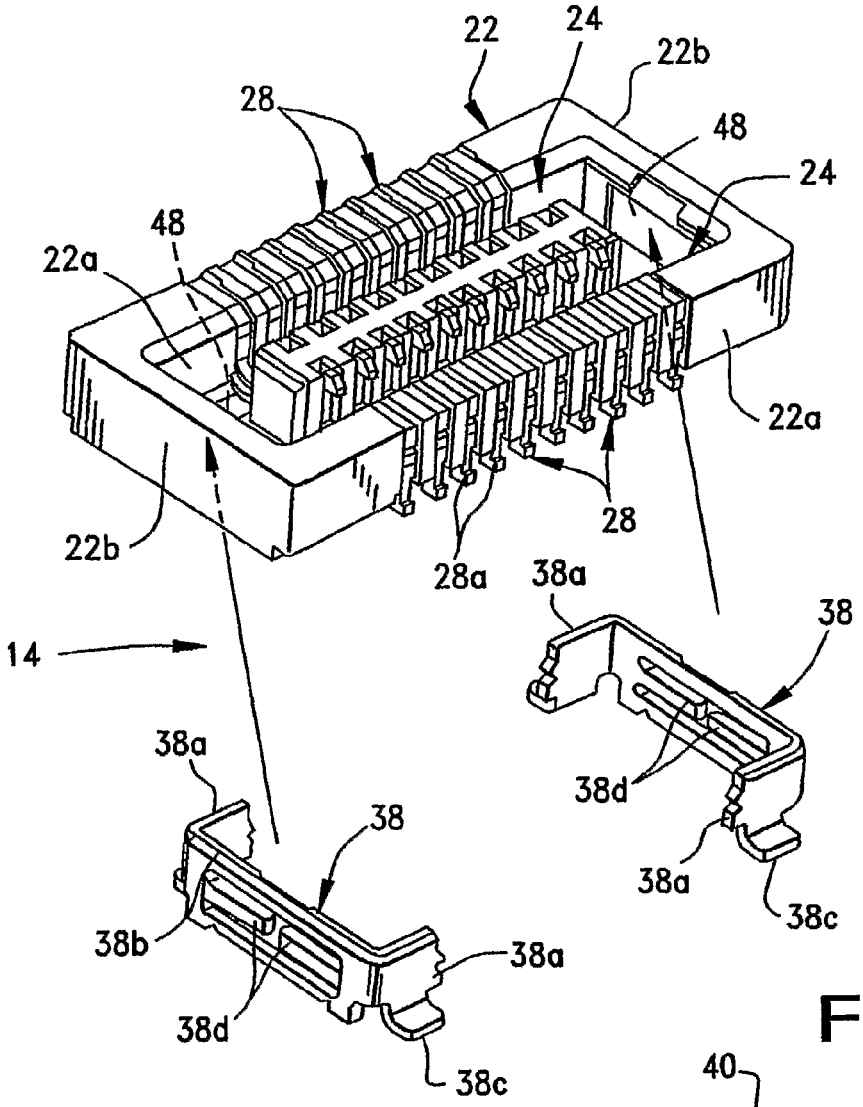
FIG. 5 is a perspective view of the bottom connector shown in FIG. 1, with the retention members removed.

More particularly, referring to FIGS. 3-5 in conjunction with FIG. 1, each retention member 38 is generally U-shaped, as defined by a pair of leg portions 38*a* joined by a plate portion 38*b*. The leg portions have feet 38*c* for connection, as by soldering, to appropriate ground pads on printed circuit board 16, whereby the retention members 38 act as ground terminals for first connector 14. A pair of flexible engaging portions or springs 38*d* are formed out of a retention opening 38*e* of plate portion 38*b*. Retention members 38 may be stamped and formed of sheet metal (spring) material, and the engaging springs 38*d* are stamped and formed, out of retention opening 38*e*.

Referring specifically to FIG. 4, the double-headed arrow "A" represents the mating direction of connectors 14 and 18 as described above in relation to FIG. 1. It can be seen that the engaging springs 38*d* are narrow and elongated, having widths "W" and lengths "L". The engaging springs extend toward each other from fixed bases 42 to adjacent distal ends 44. It can be seen that the elongated engaging springs extend in a direction generally perpendicular to mating direction "A". Therefore, the lengths "L" of the engaging springs do not increase the height of connector 14. For purposes to be described hereinafter, retention opening 38*e* has an upper retention edge 46.

Referring to FIG. 5, retention members 38 are mounted within positioning recesses 48 inside the opposite end walls 22*b* of housing 22 of first connector 14. Therefore, engaging springs 38*d* are exposed at opposite ends of receptacle 24 of the first connector.

Figure 7:
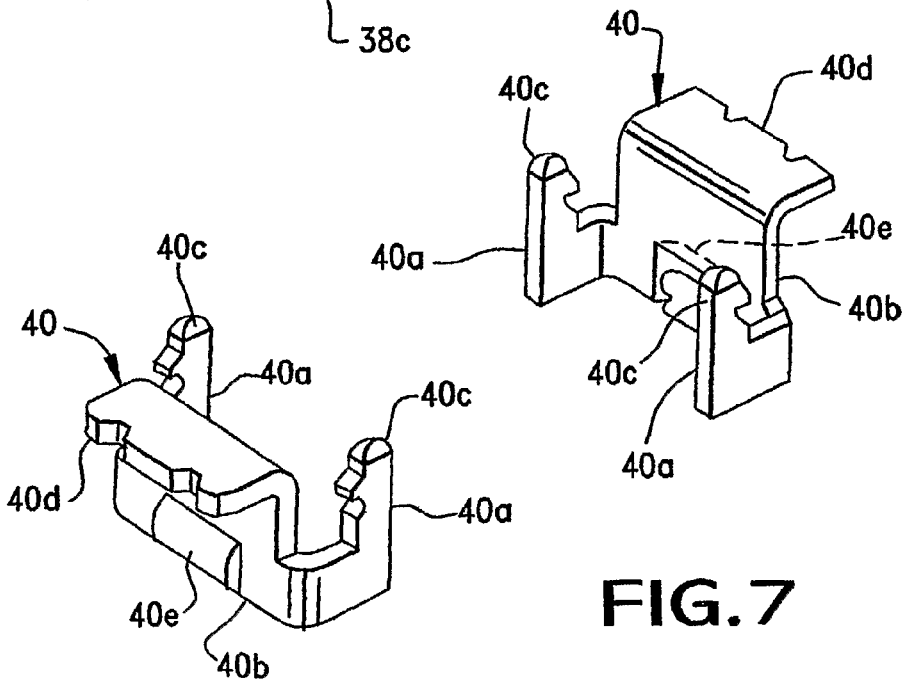
FIG. 7 is a perspective view of the two retention members mounted at opposite ends of the top or second connector in FIG. 1.

Referring to FIGS. 7-9 in conjunction with FIGS. 1 and 2, retention members 40 are mounted generally to the outsides of end walls 26*b* (FIG. 2) of housing 26 of second connector 18. Each retention member 40 is generally U-shaped to define a pair of end plate portions 40*a* and a cross plate portion 40*b*. End plates portions 40*a* have mounting leg portions 40*c*. A foot 40*d* projects outwardly from cross plate portion 40*b* for connection, as by soldering, to an appropriate ground trace on printed circuit board 20 (FIG. 10). Therefore, retention members 40 act as ground terminals for second connector 18. A rigid engaging portion or protrusion 40*a* projects outwardly from the cross plate portion 40*b* of each retention member 40. The retention members are mounted to the opposite end walls 26*b* of housing 26 by inserting the mounting leg portions 40*c* into a pair of mounting holes 50 in housing 26 in the direction of arrows "B" (FIG. 8). This positions cross plate portions 40*b* within a pair of positioning recesses 52 in the outer faces of end walls 26*b* of the housing. When so positioned, the rigid engaging protrusions 40*e* project outwardly from opposite ends of the second connector as seen best in FIG. 9.

FIG. 10 shows the first and second connectors 14 and 18, respectively, in mated condition, as having been mated in the mating direction indicated by double-headed arrow "A". In this view, the engaging springs 38*d* of retention members 38 are flexible in the direction of double-headed arrow "C". It can be understood that this flexing direction of the engaging springs is generally perpendicular to mating direction "A". FIG. 10 shows the engaging protrusion 40*e* of one of the retention members 40 of connector 18 biasing or flexing one of the engaging springs 38*d* of one of the retention members 38 of connector 14 outwardly in the direction of arrow "B". Consequently, the rigid engaging protrusion 40*e* enters the retention opening 38*e* of retention member 38 beneath the upper retention edge 46 of the opening. This retaining means 36 holds the connectors in their mated condition of FIG. 10.

It should be noted that the single engaging protrusion 40*e* of each retention member 40 engages and flexes both of the engaging springs 38*d* of the respective retention member 38.

The pair of engaging springs provide an increased retention force without in any way increasing the overall height of the connector assembly. The two engaging springs also increase the contact forces between retention members 38 and 40 to positively, electrically couple the retention members which act as ground terminals for the two connectors.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed:

1. A board-to-board electrical connector assembly, comprising:

a first connector having a dielectric housing for mounting on a first printed circuit board and including a receptacle for receiving a plug portion of a second connector mounted on a second printed circuit board, the connectors being mateable in a mating direction generally perpendicular to the first and second circuit boards;

a plurality of first conductive terminals mounted on the housing of the first connector along the receptacle for engaging a plurality of second conductive terminals mounted along the plug portion of the second connector; and a U-shaped first retention member defined by a pair of leg portions joined by a plate portion, the first retention member mounted on one of the connectors and engageable with a second retention member on the other of the connectors in the mating direction;

wherein the first retention member includes a flexible elongated and cantilevered engaging portion formed out of a retention opening of the plate portion of the first retention member, the flexible engaging portion having fixed end and a free end, the free end extending from a fixed end of the first retention member, the flexible engaging portion extending in a direction generally perpendicular to the mating direction, the second retention member including a rigid engaging portion for engaging and flexing the flexible engaging portion to hold the connectors in a mated condition; and wherein the flexible engaging portion comprises a first flexible engaging portion and includes a second flexible engaging portion cantilevered within the retention opening and extending toward the first flexible engaging portion, with the rigid engaging portion being engageable with both flexible engaging portions.

2. The electrical connector assembly of claim 1 wherein the flexible and rigid engaging portions of the first and second retention members, respectively, are located between the receptacle and the plug portion of the first and second connectors, respectively, when the connectors are mated.

3. The electrical connector assembly of claim 1 wherein the first and second retention members are mounted on the first and second connectors, respectively.

4. The electrical connector assembly of claim 3 wherein the flexible engaging portion of the first retention member is located inside the receptacle of the first connector.

5. The electrical connector assembly of claim 4 wherein the rigid engaging portion of the second retention member is located outside the plug portion of the second connector.

6. The electrical connector assembly of claim 1 wherein the receptacle of the first connector and the plug portion of the second connector are generally rectangular, including major sides and minor ends, with the terminals being spaced along the major sides and the retention members being in pairs at the minor ends.

7. A board-to-board electrical connector for mating with a complementary mating connector, comprising:

a first elongated dielectric housing having a pair of spaced apart, elongated sidewalls and a pair of end walls interconnecting the sidewalls, a plurality of terminal receiving cavities spaced along at least one of the sidewalls for mounting a plurality of terminals therein, the housing being configured for mating with a second elongated dielectric housing of the complementary connector in a mating direction and for mounting on a circuit member;

a plurality of first conductive terminals mounted on the housing for engaging a plurality of second conductive terminals of the complementary mating connector, each terminal being positioned in a respective one of the terminal receiving cavities of the first connector; and a deflectable retention member on the housing for engaging a second retention member of the complementary connector, the deflectable retention member including a cantilevered, flexible spring arm that extends in a direction generally perpendicular to the mating direction and along a line connecting the sidewalls and is configured to deflect upon engagement with an engaging portion of the second retention portion whereby the deflectable retention member engages and flexes to hold the electrical connectors in a mated condition;

wherein one of the deflectable retention members is mounted adjacent each end wall of the dielectric housing;

wherein the cantilevered, flexible spring arm is defined by a fixed base end and a free end that extends away from the fixed base end; and wherein each deflectable retention member further comprises a pair of the flexible spring arms that extend towards each other so that the free ends thereof are in close proximity.

8. The board-to-board electrical connector of claim 7, wherein the deflectable retention member is conductive and formed from sheet metal material.

9. The board-to-board electrical connector of claim 8, wherein the flexible spring arm of the deflectable retention member is formed out of and positioned within a retention opening in the sheet metal material.

10. The board-to-board electrical connector of claim 7, wherein the engaging portion of the second retention portion is rigid and engages the free ends of the pair of flexible spring arms.

11. An electrical connector assembly, comprising:

a first connector configured to be mounted on a first circuit member and including a generally rectangular first dielectric housing having major sides and minor ends for mating with a generally rectangular second dielectric housing of a second connector configured to be mounted on a second circuit member, the second housing having major sides and minor ends, and the first and second connectors being mateable in a mating direction;

a plurality of first conductive terminals mounted on the first dielectric housing along the major sides thereof and configured for engaging a plurality of second conductive terminals mounted on the second dielectric housing along the major sides thereof;

a first retention member mounted at each of the minor ends of the first dielectric housing of the first connector, the first retention member including a flexible, elongated, and cantilevered spring arm with a longitudinal axis extending in a direction generally transverse to the mating direction; and a second retention member mounted at each of the minor ends of the second dielectric housing of the second connector, each second retention member including a rigid engaging portion for engagement with and flexing of the elongated flexible engaging portion of the respective first retention member to hold the connectors in mated conditions;

wherein the elongated flexible engaging portion of each first retention member includes a first and second flexible, cantilevered spring arms within a retention opening in the first retention member with the flexible, cantilevered spring arms extending toward each other, and configured to engage the rigid engaging portion of the respective second retention member upon mating of the first and second connectors together.

12. The electrical connector assembly of claim 11, wherein the first dielectric housing is a receptacle and the second dielectric housing is a plug.

13. The electrical connector assembly of claim 12, wherein each first retention member is mounted within a positioning recess in the receptacle and the rigid engaging portion of the second retention member is located adjacent an outside surface of the plug.

14. The electrical connector assembly of claim 11, wherein the mating direction is generally perpendicular to planes of the first and second circuit members.

* * * * *